US005212356A

United States Patent [19]

English

[11] Patent Number: 5,212,356

[45] Date of Patent: May 18, 1993

[54] COMPUTER KEYBOARD WITH FLEXIBLE DOME SWITCH LAYER

[75] Inventor: George English, Spokane, Wash.

[73] Assignee: Key Tronic Corporation, Spokane, Wash.

[21] Appl. No.: 930,075

[22] Filed: Aug. 14, 1992

[51] Int. Cl.[5] ..... H01H 13/70

[52] U.S. Cl. ..... 200/5 A; 200/513

[58] Field of Search ..... 200/5 A, 512–517, 200/341–345, 329

[56] References Cited

U.S. PATENT DOCUMENTS

| | | | |
|---|---|---|---|
| 3,389,902 | 6/1966 | Young | 200/407 X |
| 3,941,953 | 3/1976 | Misson et al. | 200/5 R |
| 3,947,390 | 3/1976 | Johnson | 200/5 R |
| 3,952,174 | 4/1978 | Boulanger et al. | 200/5 A |
| 4,160,886 | 7/1979 | Wright et al. | 200/5 A |
| 4,518,833 | 5/1985 | Watkins | 200/5 A |
| 4,571,466 | 2/1986 | Iida | 200/5 A |
| 4,764,770 | 8/1988 | Church | 200/5 A |

*Primary Examiner*—J. R. Scott

*Attorney, Agent, or Firm*—Wells, St. John, Roberts, Gregory & Matkin

[57] ABSTRACT

As a preferred embodiment, a computer keyboard dome sheet is illustrated in the figures showing a extruded sheet 30 with an elongated body 32 with parallel extruded ridges 44 corresponding to the keyboard rows 16*a*–16*f*. Apertures or cutouts are formed in the ridges 46 at desired intervals between the key positions to form individual ridge domes 48 having parallel front and rear walls 54 and 56 that are collapsible to bring a switch actuating keel 66, 92 into engagement with the switch structure to actuate an electrical switch to indicate that the key switch has been depressed.

10 Claims, 2 Drawing Sheets

COMPUTER KEYBOARD WITH FLEXIBLE DOME SWITCH LAYER

TECHNICAL FIELD

This invention relates to computer keyboards having resilient dome switches.

BACKGROUND OF THE INVENTION

Numerous computer keyboards utilize a flexible sheet or layer of nonconductive material beneath the key caps in which the flexible sheet has molded dome portions at each key position to serve as a "return spring" to return a depressed key to it original undepressed condition. Examples as such flexible dome sheets are shown in several U.S. patents including U.S. Pat. No. 4,571,466 granted to Iida. A further example is illustrated in FIG. 1. A flexible keyboard dome switch layer or sheet 10 is illustrated in FIG. 1 having an alphanumeric layout with additional function keys and keypad keys. The keyboard layout is frequently referred to as a one-hundred and one key keyboard layout having one-hundred and one keyswitch positions 14. The keyswitch positions 14 are arranged in a plurality of parallel key rows 16*a*–16*f*. The sheet 10 has a base 18 that is normally supported on a rather rigid support plate or printed circuit board with a plurality of integral upstanding dome resilient bodies 20. The sheet 10 is molded from a flat sheet of resilient material with each dome body 20 being formed under heat and pressure within the mold cavity. Each dome body 20 has a cylindrical or circular-cross section, dome-shaped upstanding sidewall extending upward from the base 18 at each key position 14 for engaging a key cap structure to spring bias the key cap to an elevated condition in which the keyswitch is unactuated. Often the dome body has an actuating element formed integrally with the body that either directly or indirectly actuates the keyswitch when the key cap is depressed by the keyboard operator.

Although computer keyboards having flexible dome layers have become popular during the past 10 years, they are not with their disadvantages. Production quality molds are rather expensive to construct and as such are generally only justified when rather large volumes of dome sheets are required. Additionally, a separate mold is generally required for each different key layout, requiring the construction of a separate mold for each different keyboard layout. Moreover, the mold cycle time (time required to load an unmolded sheet into the mold, close the mold, open the mold, and to let the molded sheet cool) is not insignificant, limiting the cost effectiveness of resilient dome switch layers in keyboards as substitutes or alternatives to other types of key switch return spring structures.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
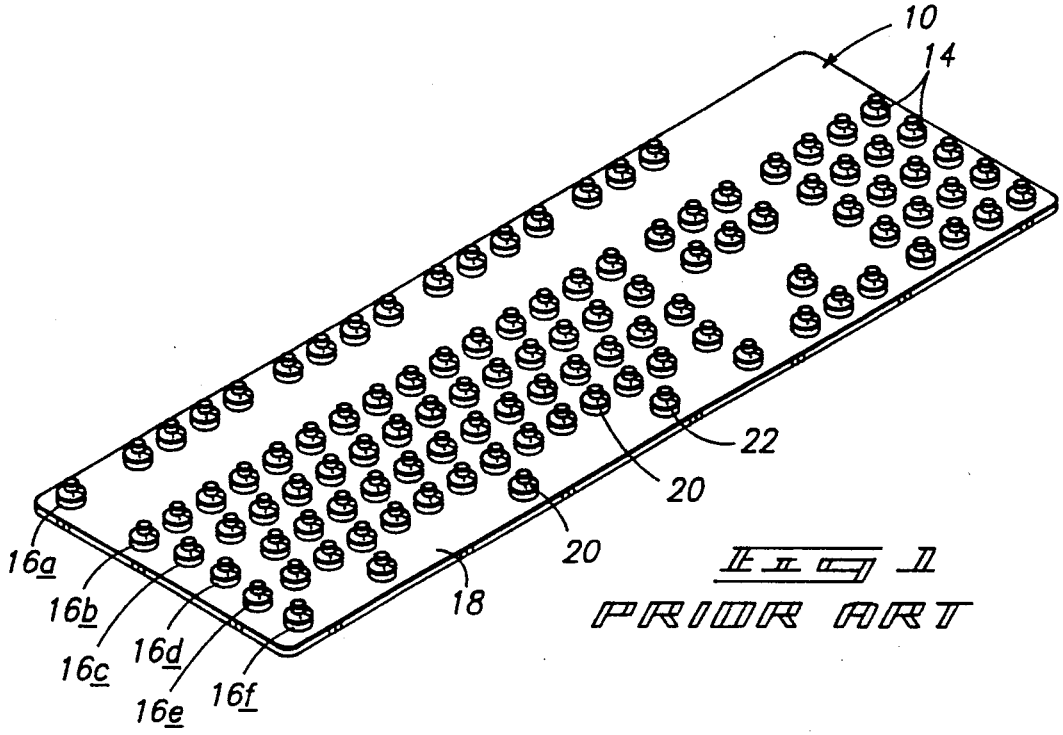
Fig 1 PRIOR ART
FIG. 1 is an isometric view of a prior art keyboard dome switch layer or sheet.
Figure 2:
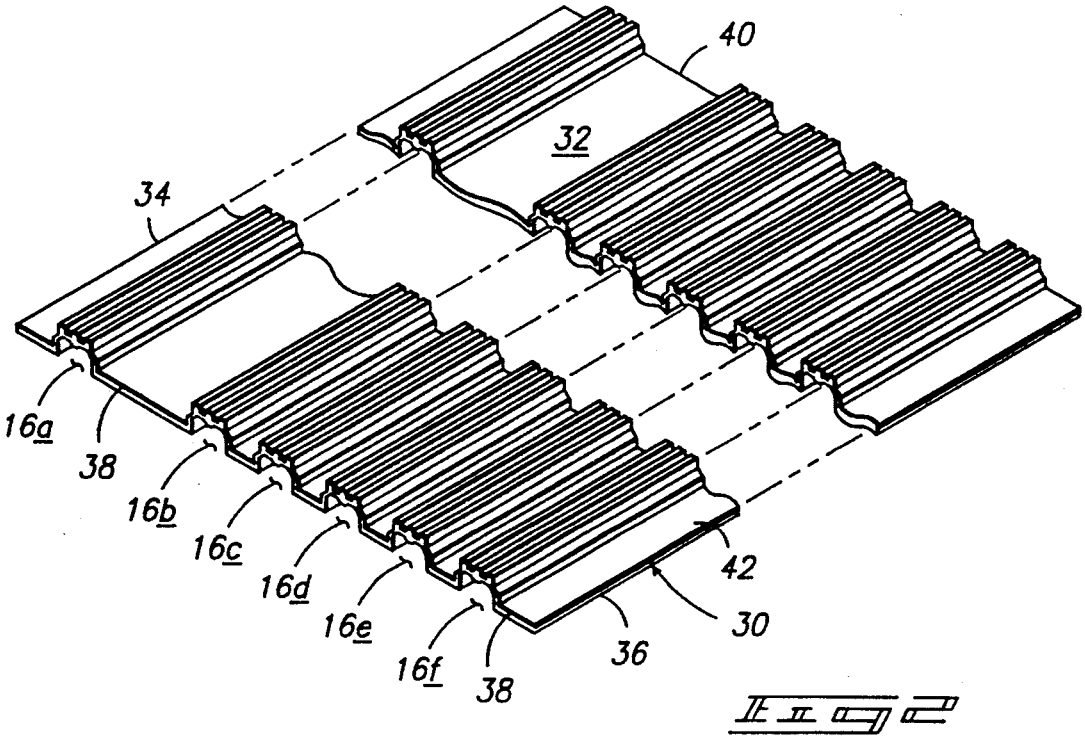
FIG. 2 is an isometric view of a preferred embodiment of a keyboard dome switch layer of the present invention prior to the layer being fully manufactured.
Figure 3:
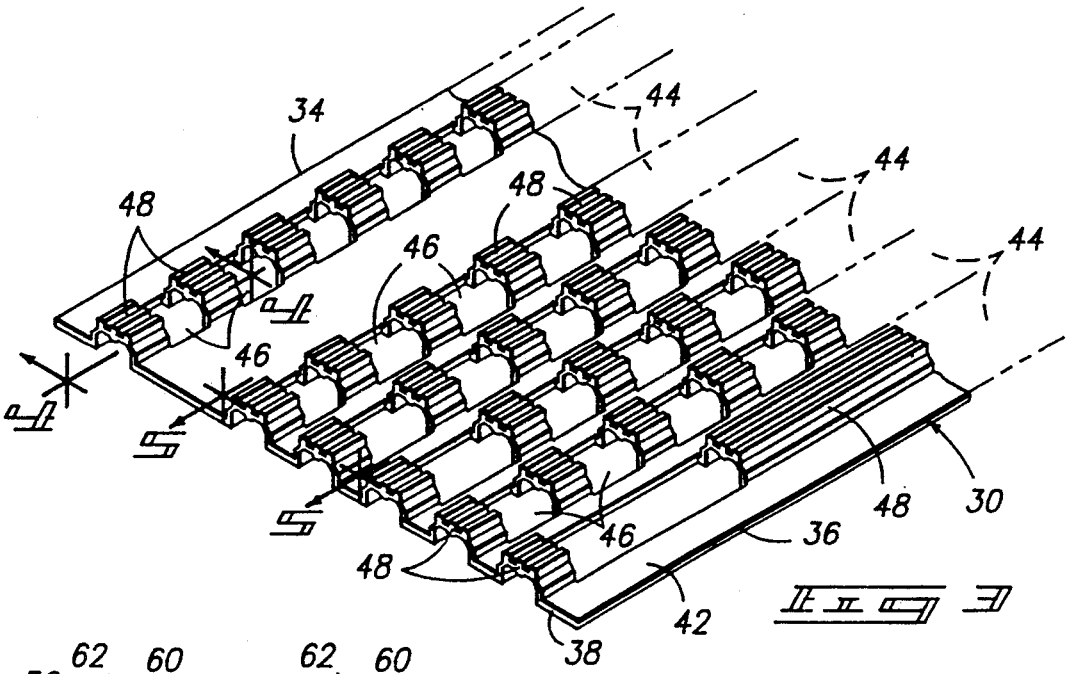
FIG. 3 is a fragmentary isometric view of the keyboard dome switch layer upon final construction.

The preferred embodiment of this invention is illustrated in FIGS. 2 and 3 showing a keyboard dome sheet 30 that is extruded from synthetic rubber material rather than molded. The sheet 30 has an elongated body 32 having a front-to-back dimension between a top edge 34 and a bottom edge 36. Elongated body 32 extends to side edges 38. The dome sheet 30 is extruded along the longitudinal length of the body between the side edges 38. The dome sheet 30 may be made from a rather infinite length of material that is extruded in which the dome sheet 30 is cut at selected intervals depending upon the keyboard layout and the size of the keyboard housing.

The sheet 30 has a base 42 with a plurality of extruded ridges 44 that are extruded parallel with each other and complementary to the keyboard rows 16*a* through 16*f* as illustrated in FIG. 2.

To form individual domes, apertures or cutouts 46 are formed in the extruded ridges at locations intermediate the key switch positions to define individual ridge domes 48 at each of the key positions. Each of the ridged domes 48 includes side edges 50 and 52 and front wall 54 and rear wall 56. The front and rear walls 54 and 56 are part of the extruded ridges 44 and are parallel to each other. Each of the front and rear walls 54, 56 having an incline section 58 that extend upward and inward towards each other from the base 42. Each of the individual ridged domes 48 includes an integral bridging crown 60 that is formed of a thicker material than the walls 54 and 56. The bridging crown 60 includes a top surface 62 and an underlying surface 64. The bridging crown 60 further includes an elongated switch actuating keel 66 in the underlying surface 64 for actuating a key switch structure when the key is depressed. The bridging crown 60 further includes longitudinal grooves 68 for facilitating the progressive controlled collapse of an individual ridge dome 48, as the ridged dome 48 is depressed.

Each of the individual ridged domes 48 overlie a computer keyboard key switch generally designated with the numeral 70 for operating an electrical circuit that indicates that the key has been depressed. In the embodiment that is illustrated in FIGS. 4 and 5, the key switch structure 70 is of a membrane type key switch whereas the configuration in FIG. 6 is a printed circuit board bridging circuit.

Figure 4:
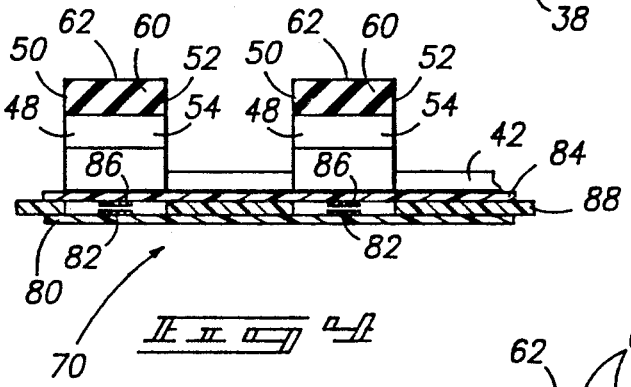
FIG. 4 is a vertical cross-sectional view taken along line 4—4 in FIG. 3 showing the shape of two adjacent dome elements in the lateral direction and the location of the two dome elements with respect to an underlying membrane type keyswitch structure.
Figure 5:
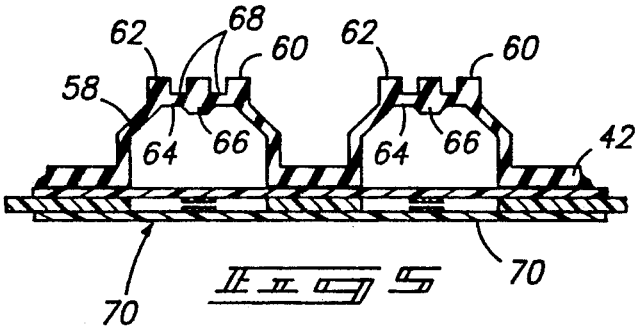
FIG. 5 is a vertical cross-sectional view similar to FIG. 4 except as taken along line 5—5 in FIG. 3 showing the shape of two adjacent dome elements in a front-to-back direction.

With respect to FIGS. 4 and 5, the computer keyboard key switch structure 70 includes a printed circuit board layer 80 that has an electrical contact or electrical land 82 formed thereon at each key switch position. The key switch 70 further includes a flexible membrane layer 84. Electrical contact 56 is formed on the underside of the flexible membrane at each switch location. A nonconductive spacer layer 88 is mounted between the flexible membrane layer 84 and the printed circuit board layer 80 to normally separate the electrical contacts 82 and 86. When an individual ridge dome 48 is depressed, the keel 66 engages the flexible membrane 84 and moves the membrane downward to bring the electrical contact 86 into electrical engagement with the electrical contact 82 to complete the electrical circuit.

Figure 6:
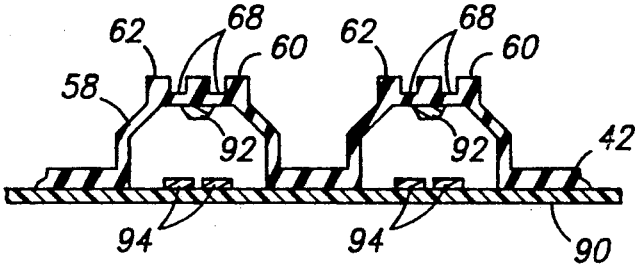
FIG. 6 is a vertical cross-sectional view similar to FIG. 5 except showing the two dome elements with respect to a bridge switch structure in which each dome element has a conductive portion.

The embodiment illustrated in FIG. 6 is an alternative in which the extruded ridges 44 are formed with a conductive switch actuating keel 92 rather than the nonconductive keel 66. This enables the individual ridge domes 48 to be utilized in an alternative switch structure generally referred to as a printed circuit board bridging circuit having a printed circuit layer 90 (FIG. 6) in which switch contact targets or lands 94 are mounted on the printed circuit board. When the individual ridge dome 48 is depressed, the conductive switch actuating keel 92 is brought into contact in a bridging manner between the switch contact targets 94 to complete the electrical circuit.

It should be appreciated that the extruded keyboard dome sheet 60 has many advantages in that a single continuous length extruded sheet member can be formed and then separated into keyboard dome sheets in which each of the extruded ridges 44 correspond to a key row 16*a*–16*f*. The apertures or cutouts 46 are formed in the sheet dividing the extruded ridges 44 into individual ridge domes 48 at the selected key switch positions 14. Consequently the same extruded sheet can be utilized for a wide variety of keyboard switch layouts. Additionally it is not necessary to form a separate mold for each keyboard layout. For these reasons there is a substantial cost advantage to the present invention. Furthermore, extrusion dies are generally less expensive to construct than pressure molds.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. In a computer keyboard having key switches positioned at spaced key locations in a preselected array having a plurality of parallel key rows, a flexible dome sheet;

said flexible dome sheet being extruded with a base and a plurality of parallel dome ridges extending upward from the base corresponding to the key rows;

said extruded dome sheet having a plurality of apertures formed in the dome ridges at selected locations along the ridges defining individual ridge domes between the apertures at spaced locations corresponding to the spaced key locations.

2. In the computer keyboard as defined in claim 1 wherein each of the individual ridge domes have resilient opposing side walls extending upward from the base that are collapsible upon depression of a corresponding key.

3. In the computer keyboard as defined in claim 1 wherein each of the individual ridge domes have a bridging crown interconnecting the side walls and overlying a corresponding keyswitch for actuating the corresponding keyswitch upon depression of the corresponding key.

4. In the computer keyboard as defined in claim 1 wherein the opposing side walls of each individual ridge dome are parallel with each other.

5. In the computer keyboard as defined in claim 1 wherein the side walls of each individual ridge dome of a ridge are linearly aligned with each other.

6. In the computer keyboard as defined in claim 1 wherein the side walls are inclined inward toward each other.

7. In the computer keyboard as defined in claim 1 wherein the bridging crown has a bottom surface with an elongated actuation keel for actuating the keyswitch when the key is depressed.

8. In the computer keyboard as defined in claim 1 wherein the actuation keel is formed of an electrically conductive material.

9. In the computer keyboard as defined in claim 1 wherein the actuation keel is formed parallel with the side walls.

10. In the computer keyboard as defined in claim 1 wherein the bridging crown has a top surface with an elongated groove formed therein to facilitate collapse of the individual ridge dome upon depression of the corresponding key.

* * * * *